United States Patent [19]

Hoberman

[11] Patent Number: 4,780,344

[45] Date of Patent: Oct. 25, 1988

[54] REVERSIBLY EXPANDABLE THREE-DIMENSIONAL STRUCTURE

[76] Inventor: Charles S. Hoberman, 472 Greenwich St., New York, N.Y. 10013

[21] Appl. No.: 903,001

[22] Filed: Sep. 2, 1986

[51] Int. Cl.[4] ..... A63H 33/16

[52] U.S. Cl. ..... 428/12; 428/542.8; 446/488

[58] Field of Search ..... 446/117, 487, 488; 428/12, 542.8

[56] References Cited

U.S. PATENT DOCUMENTS

| | | | |
|---|---|---|---|
| 1,802,101 | 4/1931 | Wood | 428/542.8 X |
| 1,997,022 | 4/1935 | Stalker | 428/542.8 X |
| 2,164,966 | 7/1939 | Tutein | 446/488 X |
| 2,922,239 | 1/1960 | Glynn, Jr. | 446/488 X |
| 3,302,321 | 2/1967 | Walker | 428/12 X |
| 3,945,561 | 3/1976 | Strebelle | 229/41 B |
| 4,140,317 | 2/1979 | Ramney | 229/72 X |
| 4,142,321 | 3/1979 | Coppa | 446/488 |
| 4,492,723 | 1/1985 | Chadwick | 428/7 |

*Primary Examiner*—Henry F. Epstein

*Attorney, Agent, or Firm*—Sprung Horn Kramer & Woods

[57] ABSTRACT

A reversibly expandable three-dimensional structure made up of a grid of elements each comprising an essentially planar four sided central zone and a pair of substantially triangular flaps hingedly connected to two opposite sides of said central zone, the elements being hingedly joined to one another central zone to central zone and flap to flap. By including some elements wherein the central zones are tapered the expanded structure will be curved.

3 Claims, 6 Drawing Sheets

REVERSIBLY EXPANDABLE THREE-DIMENSIONAL STRUCTURE

The present invention relates to the provision of firm three-dimensional expanded enclosures from essentially two-dimensional collapsed structures.

There are many times when one wishes to have an enclosure at a remote site and, rather than transport it to such site, one transports it in some collapsed form. Thus, a tent is folded up, transported and erected where needed. A canvas tent, however has no rigidity and it therefore is necessary to utilize tent poles, pegs and much rope to give the tent some degree of permanence. In addition it must be set on a reasonably firm sub-surface.

Pneumatically inflatable plastic enclosures are another form of simple enclosure but again there is much need for preparation, tie lines, etc.

For children's playhouses or other similar insubstantial structures it is desirable to produce a three-dimensional enclosure which has some rigidity without the need for a firm substrate and/or extensive rigid tie lines.

It is accordingly an object of the invention to provide an essentially two dimensional collapsed structure which can easily be reversibly expanded, erected or deployed to provide a three dimensional enclosure of moderate rigidity.

These and other objects and advantages are realized in accordance with the present invention pursuant to which there is provided a collapsed but expandable structure which is essentially two-dimensional and which is made up of a plurality of elements comprising an essentially planar four sided central zone and a pair of substantially triangular flaps hingedly connected to two opposite sides of said central zone, whereby the elements are joined to one another flap to flap and central zone to central zone.

Advantageously, the central zone is essentially a parallelogram, the flaps being hinged to a pair of short opposite sides. Each flap is preferably essentially a 45°, 45°, 90° triangle hingedly connected along its hypotenuse to a pair of short sides of the central zone, which make angles of about 45° and 135° with a pair of longer sides.

A multiplicity of such elements are interconnected through their flaps in collapsed state form a plurality of adjacent interconnected stacks of elements, the stacks being essentially accordion pleated. When a pulling force is applied to try to separate the stacks from one another there is elongation in the plane of the stacks but at the same time the elements in each stack seperate perpendicularly to the plane, thereby creating the third dimension.

The elements can be formed of any material although some stiffness is preferable. Thus even cardboard is useful but plastic, metal or wood sheets are even better. Each can be as thin as permissible for the desired resistance to puncture.

The elements may be interspersed with slightly different elements where the four sided central zones deviate from a parallelogram and the angles of the flaps vary, to impart curvature to the expanded structure, e.g. to give a generally spherical, hemispherical, cylindrical or elliptical outer surface. It is possible to join two or more essentially parallel stacks of elements so that upon expansion each stack forms a three-dimensional structure while two essentially parallel stacks also define between them honeycomb-like chambers suitable for holding objects such as wine bottles, or even people. In addition, when two or more surfaces are joined in this manner, the structure is imparted increased rigidity and better synchronicity and smoothness during expansion.

The invention will now be further described with reference to the accompanying drawings wherein:

BRIEF DESCRIPTION OF THE DRAWING FIGURES

DETAILED DESCRIPTION

Figure 1:
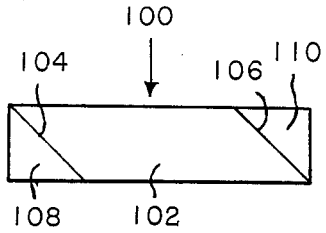
FIG. 1 is a plan view of a single element of one form of the invention.
Figure 2:
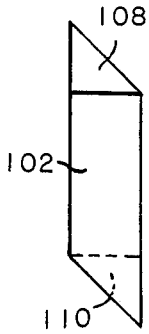
FIG. 2 is a plan view of FIG. 1 in its collapsed position.
Figure 3:
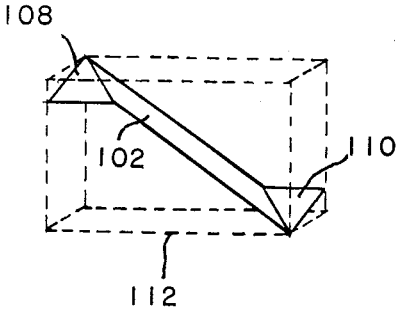
FIG. 3 is a perspective view of FIG. 1 in its deployed state.

Referring now more particularly to the drawings in FIG. 1 there is shown an element 100 which is essentially rectangular and comprises a planar central zone 102 hingedly connected along fold lines 104, 106 with triangular flaps 108, 110. In this form of the invention, zone 102 is a parallelogram where the short sides make angles of 45° and 135° with the long sides. Flaps 108, 110 are 45°, 45°, 90° triangles. In FIG. 2 the flap 108 is folded down over the face of zone 102 while flap 110 is folded rearwardly behind zone 102. In FIG. 3 it can be seen that in an erected, deployed state the flaps 108, 110 do not rest against the zone 102 but make angles therewith so as to cover or encompass a three-dimensional space 112 indicated by the dotted line.

Figure 4:
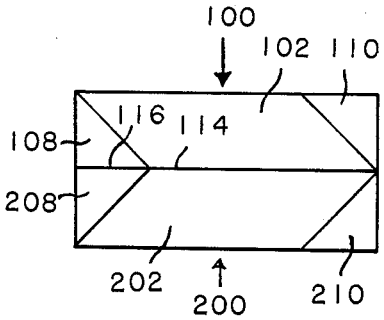
FIGS. 4 and 5 show two laterally joined elements of the invention.
Figure 5:
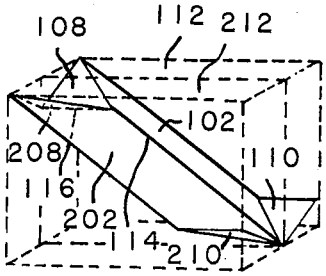

In FIG. 4 there are shown two elements 100 and 200, which in this case are mirror images, which are laterally joined to one another along fold line 114 and its continuation 116. In FIG. 5 the unit 100–200 is shown in deployed state wherein lines 114 and 116 form an angle therebetween while central zones 102, 202 also form an angle therebetween. The space encompassed thereby comprises space 112 plus 212. However, when elements 100 and 200 are folded together, they stack, and their profile is identical to FIG. 2.

Figure 6:
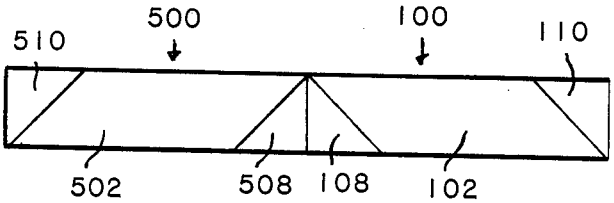
FIGS. 6, 7 and 8 show two longitudinally joined elements.
Figure 7:
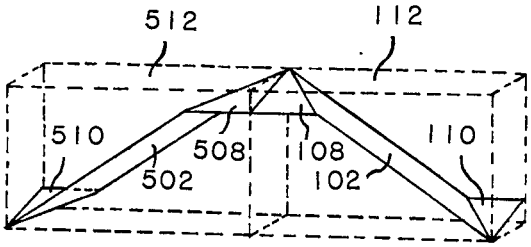
Figure 8:
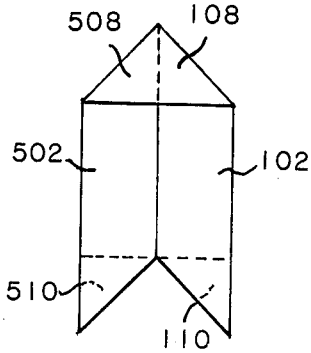

In FIG. 6 there are shown two elements 100 and 500 which are joined longitudinally, where zones 108 and 508 are joined so as to be integral and planar. In FIG. 7 the unit 100–500 is shown in deployed state where the space encompassed by unit 100–500 is space 112, plus 512. In FIG. 8 the flaps 108, 508 are folded against central zones 102, 502 respectively while the flaps 110, 510 are folded rearwardly behind zones 102, 502.

Figure 9:
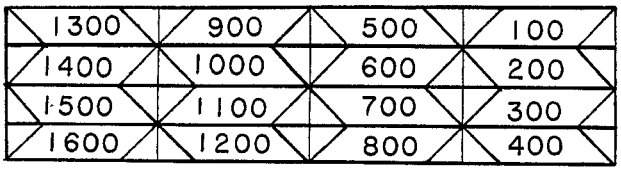
FIG. 9 shows a plan view of one form of the invention consisting of a 4×4 matrix of elements.
Figure 11:
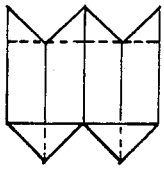
FIGS. 10 and 11 show FIG. 9 in a deployed and collapsed state respectively.
Figure 10:
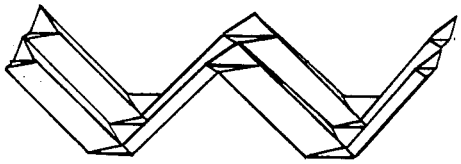

In FIG. 9 there is shown a 4×4 grid of sixteen elements consisting of four rows of elements joined central zone to central zone and flap to flap. For example one row consists of elements 100, 200, 300, 400 joined laterally to one another in the same manner as the elements in FIG. 4. Seen in an alternative fashion, the grid consists of four columns of longitudinally joined elements. One such column consists of elements 100, 500, 900, 1300 joined to one another in the same manner as FIG. 6. FIG. 10 shows the grid of elements in its deployed state which is corrugated or pleated in two different dimensions. FIG. 11 shows the matrix in its collapsed state which is stacked compactly.

Figure 12:
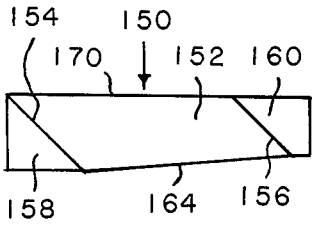
FIG. 12 shows a plan view of a single element of a curved form of the invention.
Figure 13:
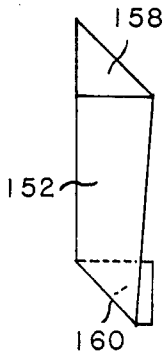
FIGS. 13 and 14 show FIG. 12 in its collapsed and deployed state respectively.
Figure 14:
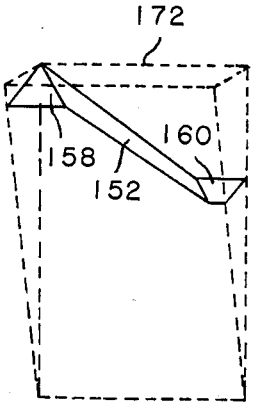

In FIG. 12 there is shown an element 150 consisting of a four sided planar tapered central zone 152, with two non-parallel sides 164, 170 hingedly connected along fold lines 154, 156 with flaps 158, 160. In FIG. 13 the flap 158 is folded down over the central zone 152 while flap 160 is folded rearwardly behind zone 152. In FIG. 14 the element 150 is shown in its deployed state encompassing the three dimensional triangular space 172 indicated by the dotted line.

Figure 15:
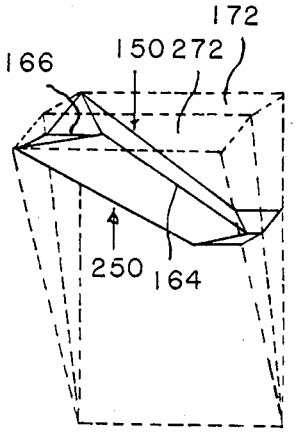
FIG. 15 shows two laterally connected elements.
Figure 16:
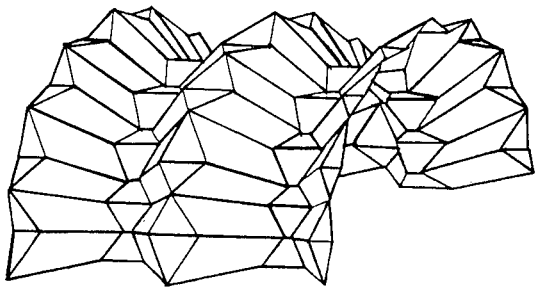
FIGS. 16 and 17 show a curved form of the invention in its deployed and collapsed states respectively.
Figure 17:
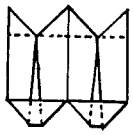

In FIG. 15 there are shown two elements 150 and 250, again mirror images, which are laterally joined along fold lines 164, 166. The encompassed space indicated by dotted lines is comprised of 172 plus 272. FIG. 16 shows a matrix consisting of four rows of sixteen elements each joined in the same manner as those in FIG. 15. By employing elements with central zones that are not parallelograms, the encompassed space will be essentially cylindrical in shape. In FIG. 17 is shown the matrix in its collapsed folded state.

Figure 18:
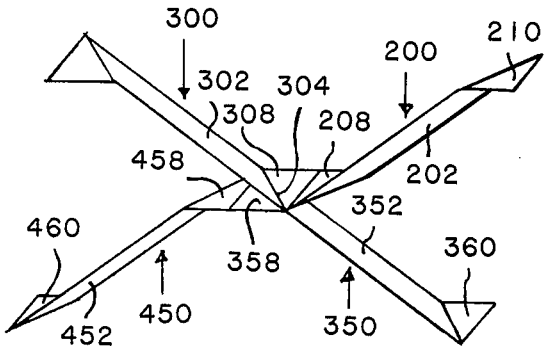
FIGS. 18–21 illustrate a modification of the invention to obtain increased strength and synchronicity of deployment.
Figure 19:
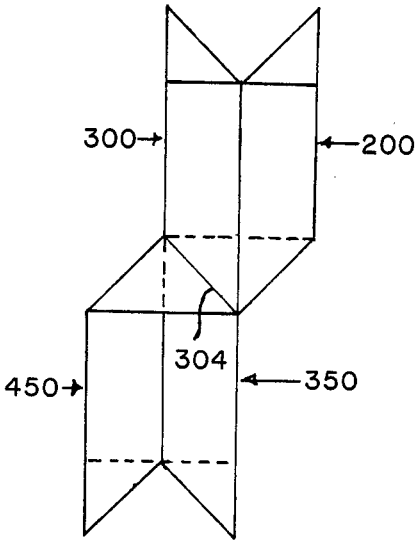
Figure 20:
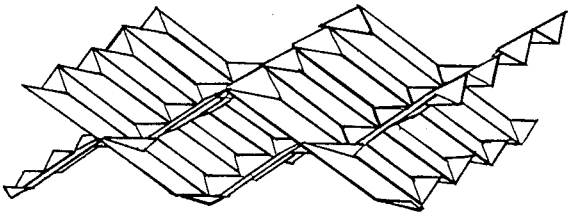
Figure 21:
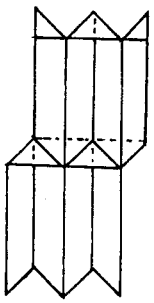

In FIG. 18 are shown two sets of pairs of individual elements in a deployed state, pair 200, 300 and pair 350, 450. Pair 200, 300 are longitudinally joined where zones 208 and 308 are joined so as to be integral and planar. Also shown is pair 350, 450 longitudinally joined by zones 358, 458. Element 300 is joined to element 350 along the hinged flap line 304. FIG. 19 shows the unit 200, 300, 350, 450 in a collapsed state. In FIG. 20 is shown a matrix made up of units identical to that shown in FIG. 18 or its mirror image. This matrix is in essence comprised of two matrices, similar to that shown in FIG. 10, joined to each other along matching fold lines producing a honeycombed structure, for purposes of reinforcement and improved synchronicity during deployment. FIG. 21 shows the matrix of FIG. 20 in its collapsed state.

Figure 22:
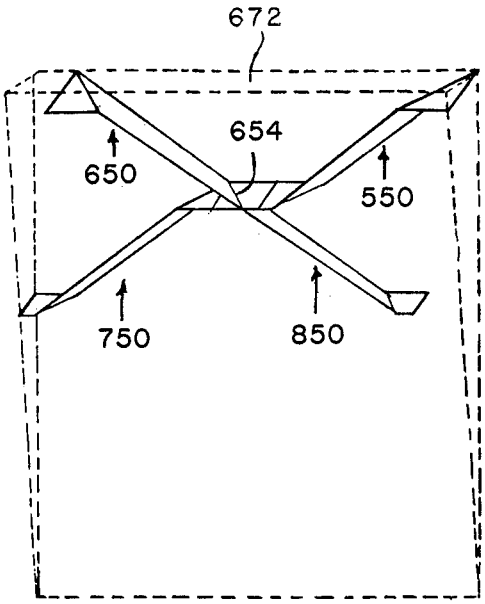
FIGS. 22–24 illustrate a modification of the invention for curved forms.
Figure 24:
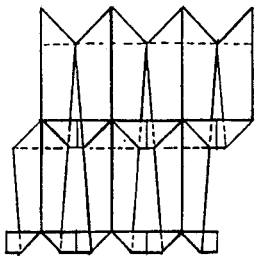
Figure 23:
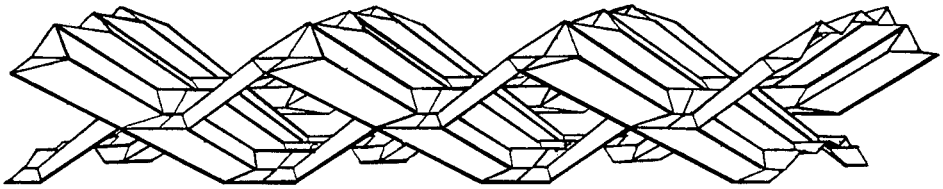

FIG. 22 shows four elements 550, 650, 750, 850 having central zones with non-parallel sides joined along fold line 654 in similar manner to those shown in FIG. 18. The encompassed space is indicated by 672. FIG. 23 shows a matrix, made up of units identical to the unit shown in FIG. 22 or its mirror image, which is a reinforced structure whose shape is essentially a section of a cylinder. FIG. 24 shows the structure in its collapsed state.

Figure 25:
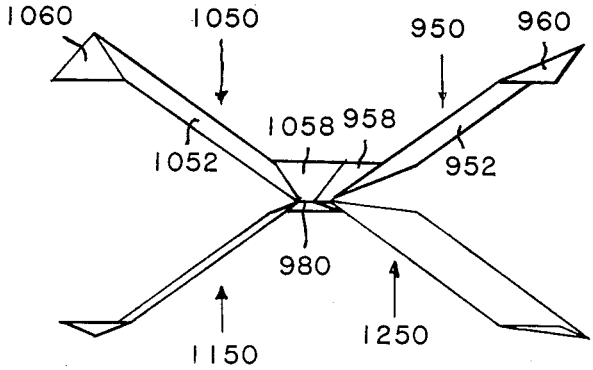
FIGS. 25–27 illustrate an alternative method for obtaining increased strength and ease of deployment.
Figure 26:
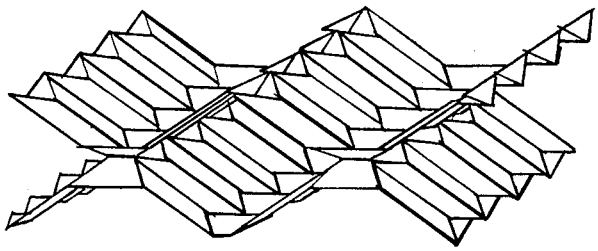
Figure 27:
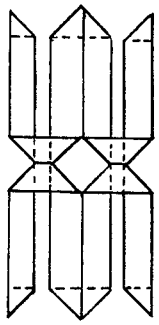

In FIG. 25 there are shown four elements 950, 1050, 1150, 1250 in a deployed state. Element 950 is comprised of a central zone 952 hingedly connected to a triangular flap 960 and a triangular flap with a rectangular extension 958. It is longitudinally joined to element 1050 where element 958 is integral and planar with element 1058 which is also a triangular flap with a rectangular extension. Elements 1150, 1250 are longitudinally joined in similar manner to elements 950, 1050. Elements 950, 1050 are joined along fold line 980 to elements 1150, 1250. FIG. 26 shows a matrix of units identical to unit 950, 1050, 1150, 1250 or its mirror imate illustrating an alternative method of joining two similar matrices for reinforcement and improved synchronicity. FIG. 27 shows the matrix in its collapsed state.

Figure 28:
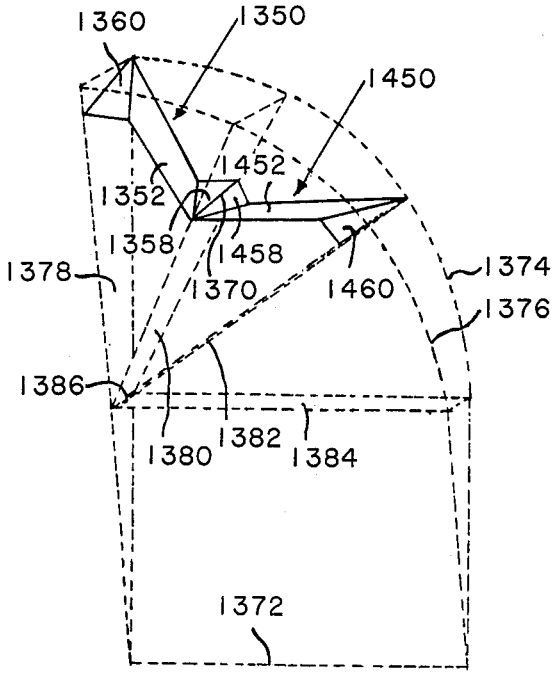
FIGS. 28–31 illustrate a form of the invention with curvature in two dimensions.

FIG. 28 shows two dissimilar elements 1350, 1450 in a deployed state. Element 1350 is comprised of a four sided tapered central zone 1352, with no two sides parallel, hingedly connected to two triangular flaps 1360, 1358. Element 1450 is comprised of a nonparallel four sided central zone 1452 hingedly connected to two triangular flaps 1458, 1460. Element 1350 is joined longitudinally to 1450 along fold line 1370. The encompassed space is comprised of a back plane 1374, consisting of a section of a circle and an extending rectangle, and a front plane 1376 of identical profile to 1374, but rotated by an angle about line 1372. Planes 1378, 1380, 1382, 1384 radiate from line 1386. Element 1350 is proportioned such that the two long sides of zone 1352 lie in plane 1374 and 1376 respectively, triangular flap 1360 has one side that lies in plane 1376 and one side in plane 1378, zone 1358 has one side in plane 1374 and one in 1380. Element 1450 is bounded by planes 1380, 1382, 1376, 1374.

Figure 29:
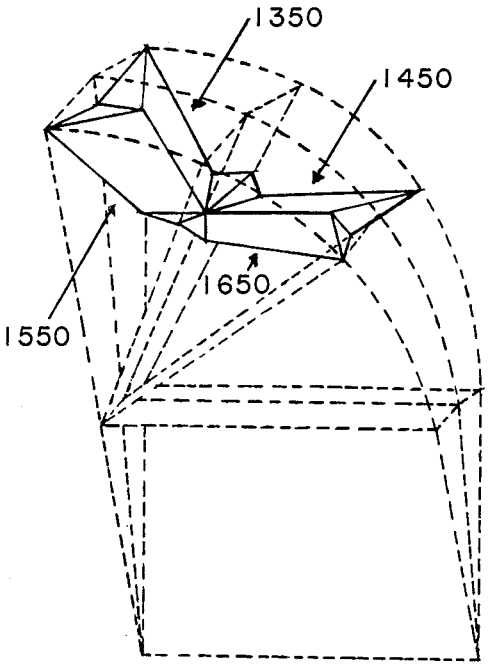

FIG. 29 shows elements 1350, 1450, 1550, 1650 where elements 1550, 1650 are the mirror image of and laterally connected to 1350, 1450. It may be seen that a volume of curvature in two dimensions may be constructed by laterally connecting to one another units identical to unit 1350, 1450, 1550, 1650.

Figure 30:
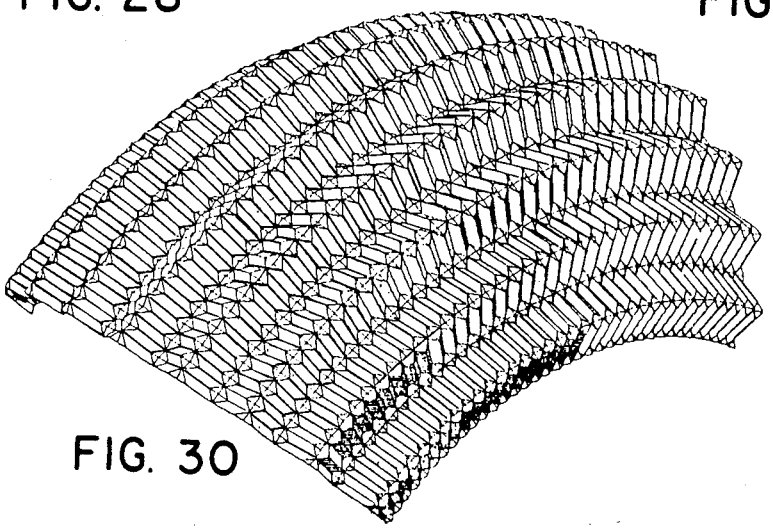
Figure 31:
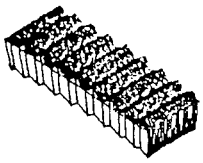

In FIG. 30 is shown a structure, curved in two dimensions, comprised of an eighteen by seventy matrix of elements. FIG. 31 shows the same structure in its collapsed position.

Figure 32:
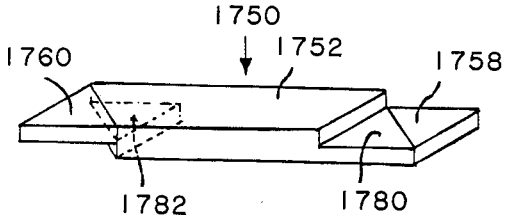
FIGS. 32–37 illustrate a method of constructing the invention out of thick materials.
Figure 33:
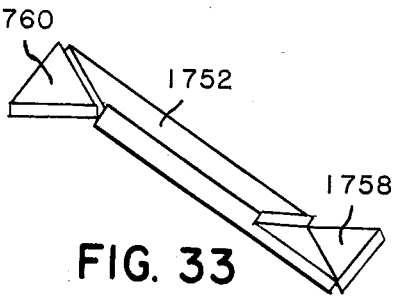
Figure 34:
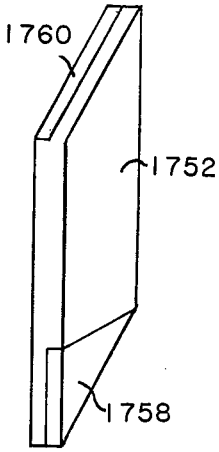
Figure 35:
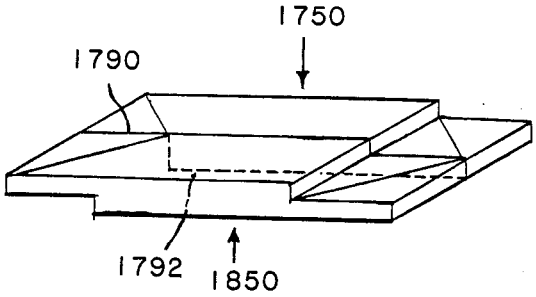
Figure 36:
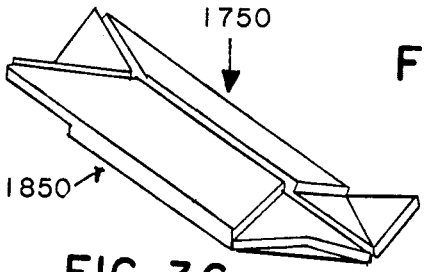
Figure 37:
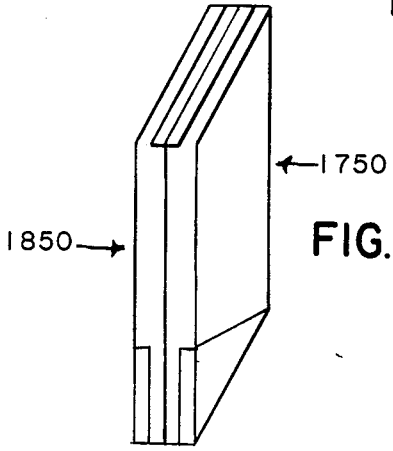

FIG. 32 shows an element 1750 in perspective, in a flat position. Central zone 1752 is a four sided shape of finite thickness. At each end of 1752, on opposite sides, are stepped areas 1780, 1782 whose thickness is equal to one half the thickness of the interior portion of 1752. The dimensions of the stepped area 1780 is equal to the dimensions of the triangular flap 1758, and the dimensions of stepped area 1782 are equal to those of 1760. FIG. 33 shows the link in its deployed position. In FIG. 34 is shown the element 1750 in its collapsed position. From FIG. 34 it may be seen that the triangular flaps 1758, 1760 rest against the stepped portion of zone 1752, so that the six surfaces of the collapsed element 1750 are smooth and planar. FIG. 35 shows element 1750 laterally connected to element 1850 along fold lines 1790, 1792, where fold line 1790 lies along the intersection of the upper surfaces of zones 1760, 1860 and fold line 1792 lies along the intersection of the lower surfaces of central zones 1752, 1852. FIG. 36 shows the unit 1750, 1850 in its deployed position. FIG. 37 shows the unit 1750, 1850 in the collapsed position.

What is claimed is:

1. An assembly for providing a reversibly expandable structure comprising at least two components each component comprising two elements, each element comprising:

a planar four-sided central zone which is essentially a parallelogram and a pair of substantially triangular flaps hingedly connected to opposite short sides of said central zone, each component comprising:

two elements where one long side of said central zone of each element is hingedly connected to the other and a side of one of the flaps of each of the two elements is hingedly connected to the other, each assembly comprising:

two components where two sides from two flaps of each component are hingedly or integrally connected to each other, whereby when a plurality of such assemblies are joined to one another flap-to-flap and central zone-to-central zone the combined elements can be reversibly expanded to a three-dimensional structure.

2. An assembly according to claim 1 wherein each flap is essentially a 45°, 45°, 90° triangle hingedly connected along its hypotenuse to a pair of short sides which make angles of about 45° and 135° with a pair of longer sides.

3. An assembly according to claim 1, wherein at least some of the elements have central zones which are not parallelograms whereby the structure when expanded is curved.

* * * * *

UNITED STATES PATENT AND TRADEMARK OFFICE

CERTIFICATE OF CORRECTION

PATENT NO. : 4,780,344

DATED : October 25, 1988

INVENTOR(S) : Charles S. Hoberman

It is certified that error appears in the above-identified patent and that said Letters Patent is hereby corrected as shown below:

Col. 5, line 2, "structure comprising at least two components each" should read --three-dimensional structure comprising at least two components, each--.

Signed and Sealed this

Twenty-fifth Day of July, 1989

*Attest:*

DONALD J. QUIGG

*Attesting Officer*

*Commissioner of Patents and Trademarks*